US009205684B2

(12) United States Patent
Kawasaki et al.

(10) Patent No.: US 9,205,684 B2
(45) Date of Patent: Dec. 8, 2015

(54) PRINTER AND PRINTER CONTROL METHOD

(71) Applicant: Seiko Epson Corporation, Tokyo (JP)

(72) Inventors: Koji Kawasaki, Matsumoto (JP); Shuhei Kurotobi, Matsumoto (JP); Ichimi Masuda, Shiojiri (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 14/584,596

(22) Filed: Dec. 29, 2014

(65) Prior Publication Data

US 2015/0109362 A1 Apr. 23, 2015

Related U.S. Application Data

(63) Continuation of application No. 13/435,443, filed on Mar. 30, 2012, now Pat. No. 8,944,555.

(30) Foreign Application Priority Data

Mar. 30, 2011 (JP) ..... 2011-074378

(51) Int. Cl.

| | |
|---|---|
| ***B41J 29/38*** | (2006.01) |
| ***B41J 13/00*** | (2006.01) |
| ***B41J 11/00*** | (2006.01) |
| ***B41J 11/30*** | (2006.01) |

(52) U.S. Cl.

CPC ..... *B41J 13/0009* (2013.01); *B41J 11/0025* (2013.01); *B41J 11/30* (2013.01)

(58) Field of Classification Search

USPC ..... 347/16

See application file for complete search history.

(56) References Cited

U.S. PATENT DOCUMENTS

| | | | | |
|---|---|---|---|---|
| 5,027,993 | A * | 7/1991 | Ferguson | 226/74 |
| 5,847,747 | A * | 12/1998 | Ishikawa | 347/262 |
| 8,944,555 | B2 | 2/2015 | Kawasaki et al. | |
| 2006/0227159 | A1 * | 10/2006 | Nakajo | 347/15 |
| 2012/0249656 | A1 | 10/2012 | Kawasaki et al. | |

FOREIGN PATENT DOCUMENTS

| | | | |
|---|---|---|---|
| JP | 2005-001303 | A | 1/2005 |
| JP | 2005-343643 | A | 12/2005 |

* cited by examiner

*Primary Examiner* — Jason Uhlenhake

(74) *Attorney, Agent, or Firm* — Nutter McClennen & Fish LLP; John J. Penny, Jr.

(57) ABSTRACT

A printer capable of preventing clogging the printhead nozzles due to paper dust produced from sprocket holes in continuous paper, and preventing the printhead from ejecting ink droplets except on the continuous paper, has a printhead that ejects ink droplets toward continuous paper having sprocket holes formed along both sides of the paper width; a cover member that covers the edge part of the width of the continuous paper where sprocket holes are formed in the range of the printhead in the conveyance direction of the continuous paper, and can move in the paper width direction; and a detection mechanism that detects the position of the cover member in the paper width direction.

6 Claims, 9 Drawing Sheets

PRINTER AND PRINTER CONTROL METHOD

Priority is claimed under 35 U.S.C. §119 to Japanese Application No. JP 2011-074378 filed on Mar. 30, 2011, which is hereby incorporated by reference in its entirety.

BACKGROUND

1. Technical Field

The present invention relates to a printer that prints by ejecting ink droplets onto continuous paper, and to a method of controlling the printer.

2. Related Art

Inkjet printers that print by ejecting ink droplets onto continuous paper having sprocket holes formed at a specific interval along both edges of the paper width are known from the literature. See, for example, Japanese Unexamined Patent Appl. Pub. JP-A-2005-1303. The inkjet printer described in JP-A-2005-1303 has a line head (printhead) with nozzles formed across the entire length of the paper width, and prints to continuous paper by ejecting ink droplets from the line head. This inkjet printer also has a tractor that conveys the continuous paper by engaging the sprocket holes in the continuous paper.

Paper dust is easily produced from the sprocket holes when using continuous paper with sprocket holes. The paper dust produced from the sprocket holes can easily clog the nozzles of the printhead in the inkjet printer, easily resulting in dropped dots and a drop in print quality. Also, inkjet printers that print on continuous paper generally print to continuous paper based on print commands from a printer driver. As a result, if the width of the continuous paper specified by the printer driver and the actual width of the continuous paper set in the inkjet printer differ, the printhead may eject ink droplets outside the width of the continuous paper.

SUMMARY

A printer according to at least one embodiment of the present invention can prevent clogging of the nozzles in the printhead by paper dust from the sprocket holes in continuous paper while also preventing the printhead from ejecting ink droplets at places other than on the continuous paper.

Another aspect of at least one embodiment of the invention is a printer control method that can prevent the printhead from ejecting ink droplets to places outside the continuous paper even in a printer that can prevent clogging of the nozzles in the printhead by paper dust from the sprocket holes in continuous paper.

One aspect of at least one embodiment of the invention is a printer having: a printhead that ejects ink droplets toward continuous paper having feed holes formed therein at a specific interval along both edge parts of the paper width; a cover member that covers an edge part of the width of the continuous paper where the feed holes are formed in the conveyance direction of the continuous paper at least in the printhead installation area and can move in the paper width direction; a detection mechanism that detects a position of the cover member in the paper width direction; and a paper edge position detection means that determines the position of an edge of the continuous paper in the paper width direction based on the detected position of the cover member in the paper width direction.

A printer according to at least one embodiment of the invention has a cover member that covers an edge part of the width of the continuous paper in which feed holes are formed in the printhead installation area at least in the continuous paper conveyance direction. As a result, paper dust produced at the feed holes can be prevented from floating up toward the printhead by the cover member. Paper dust produced in the feed holes can therefore be prevented from sticking to the nozzles of the printhead, and clogging of the printhead nozzles by paper dust can be prevented as a result.

In addition, because the cover member can move in the paper width direction, the feed holes can be covered by the cover member when the width of the continuous paper used in the printer changes by moving the cover member in the paper width direction. Clogging the nozzles of the printhead by paper dust can therefore be prevented even if the width of the continuous paper used in the printer changes.

The printer of at least one embodiment of the invention also has a detection mechanism that detects the position of the cover member in the paper width direction, and a paper edge position detection means that determines the position of an edge of the continuous paper in the paper width direction based on the detected position of the cover member in the paper width direction.

The position of the edge of the continuous paper in the paper width direction can therefore be detected based on the detected position of the cover member even if the widthwise edge of the continuous paper where the feed holes are formed is covered by the cover member, and the width of the continuous paper set in the printer can be determined. The invention can therefore print to continuous paper by the printhead within the identified range of the paper width, and the printhead can be prevented from ejecting ink droplets outside of the width of the continuous paper.

A printer according to the invention preferably also has a tractor that can move in the paper width direction and conveys the continuous paper while engaging tractor pins sequentially in the feed holes; and a connecting member that connects the tractor and the cover member; the cover member and the tractor moving together in the paper width direction.

If the tractor is moved in the paper width direction when the width of the continuous paper used in the printer changes, the cover member moves with the tractor in the paper width direction. The feed holes can therefore be covered by the cover member even when the width of continuous paper used in the printer changes by simply moving the tractor. The cover member can therefore also be easily moved, and the cover member can be reliably moved when the continuous paper changes.

Because the cover member and tractor move together in the paper width direction, the distance between the tractor pins and the cover member in the paper width direction is always substantially the same, and as a result the distance between the cover member and the feed holes of the continuous paper engaged by the tractor pins is always substantially constant in the paper width direction. More specifically, the distance between the edge of the continuous paper and the cover member in the paper width direction is always substantially constant. The position of the edge of the continuous paper can therefore be determined with good precision based on the result of detecting the position of the cover member, and the width of the continuous paper can be determined with good precision as a result.

The detection mechanism is a reflective photodetector including a light-emitting device and a photodetection device that detects light emitted from the light-emitting device and reflected by the cover member.

This configuration enables detection of the position of the cover member by the detection mechanism by positioning the detection mechanism above the cover member. The detection mechanism can also be positioned more easily when the detection mechanism is a transmissive photodetector having the light-emitting device and photodetector disposed with the cover member therebetween.

A printer according to another aspect of at least one embodiment of the invention preferably also has a carriage on which the printhead is mounted and which can move in the paper width direction; the detection mechanism being disposed to the carriage.

This configuration enables positioning the detection mechanism near the printhead. The edge of the continuous paper detected from the detection result of the detection mechanism, and the edge of the part of the continuous paper to which the printhead actually ejects ink droplets, can therefore not shift easily. As a result, the printhead can be reliably prevented from ejecting ink droplets outside of the continuous paper. The position of the cover member that can move in the paper width direction can also be detected using a single detection mechanism.

A printer according to another aspect of at least one embodiment of the invention preferably also has a plurality of platen sections that are disposed in the printhead installation area in the conveyance direction and separated in the paper width direction; a cover reflector that reflects light and is disposed on the cover member; and a platen reflector that reflects light and is disposed on a platen section, wherein the width of the cover reflector in the paper width direction and the width of the platen reflector in the paper width direction are different, and the detection mechanism is a reflective photodetector including a light-emitting device and a photodetection device that detects light emitted from the light-emitting device and reflected by the cover reflector or the platen reflector.

Further preferably, the carriage moves so that the detection mechanism crosses the cover reflector and the platen reflector; and the paper edge position detection means differentiates whether the cover reflector or the platen reflector was detected, and detects the position of the cover member in the paper width direction, based on the time that the photodetection device detects light reflected by the cover reflector, and the time that the photodetection device detects light reflected by the platen reflector.

Because the width of the cover reflector and the width of the platen reflector in the paper width direction are different, the time that the photodetector detects light reflected by the cover reflector and the time that the photodetector detects light reflected by the platen reflector are different. The cover member and the platen section can therefore be differentiated, and the position of the cover member can be appropriately detected, based on the photodetection time of the photodetector even if the section platen is in the area where the printhead is located.

Another aspect of at least one embodiment of the invention is a method of controlling a printer that has a printhead that ejects ink droplets toward continuous paper having feed holes formed therein at a specific interval along both edge parts of the paper width, and a cover member that covers an edge part of the width of the continuous paper where the feed holes are formed in the conveyance direction of the continuous paper at least in the printhead installation area and can move in the paper width direction, the control method including steps of: detecting a position of the cover member in the paper width direction; and determining the position of an edge of the continuous paper in the paper width direction based on the detected position of the cover member in the paper width direction.

Because the edge part of the width of the continuous paper in which feed holes are formed is covered by the cover member in the printhead installation area at least in the continuous paper conveyance direction, paper dust produced at the feed holes can be prevented from sticking to the nozzles of the printhead, and clogging of the printhead nozzles by paper dust can be prevented as a result.

In addition, because the cover member can move in the paper width direction, the feed holes can be covered by the cover member even when the width of the continuous paper used in the printer changes by moving the cover member in the paper width direction. Clogging the nozzles of the printhead by paper dust can therefore be prevented even if the width of the continuous paper used in the printer changes.

The invention detects the position of the cover member in the paper width direction, and determines the position of the edge of the continuous paper in the paper width direction based on the detected position of the cover member in the paper width direction. As a result, even if the widthwise edge of the continuous paper where the feed holes are formed is covered by the cover member, the position of the edge of the continuous paper in the paper width direction can be determined based on the result of detecting the position of the cover member, and the width of the continuous paper set in the printer can be determined. The printer control method according to the invention can therefore print to continuous paper by the printhead within the identified range of the paper width, and as a result can prevent the printhead from ejecting ink droplets outside of the width of the continuous paper, even in a printer that can prevent clogging of the printhead nozzles due to paper dust produced from the feed holes in continuous paper.

DESCRIPTION OF EMBODIMENTS

A printer according to a preferred embodiment of the invention is described below with reference to the accompanying figures.

General Configuration of the Printer

Figure 1:
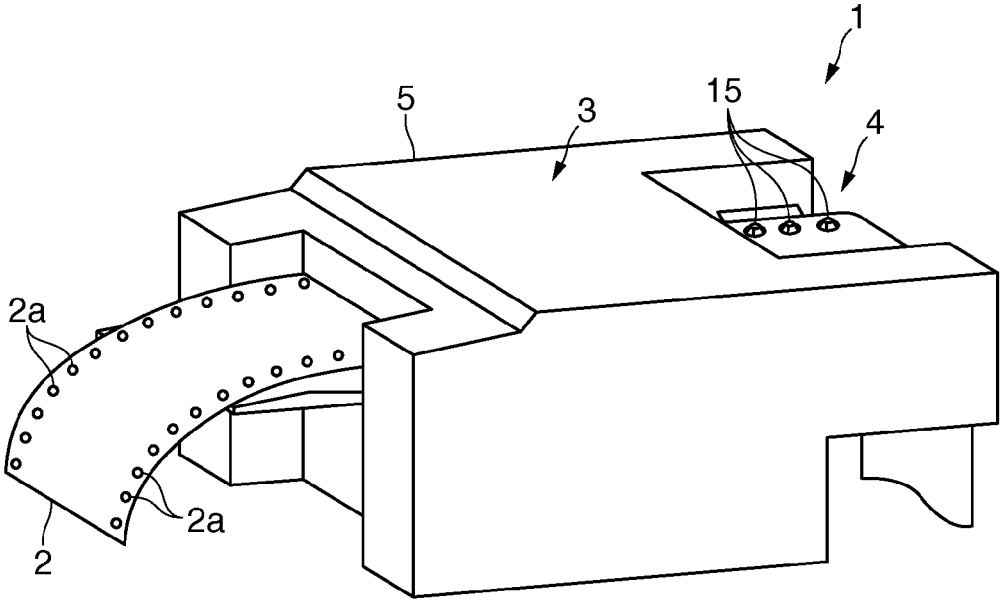
FIG. 1 is an oblique view of a printer according to a preferred embodiment of the invention.
Figure 2:
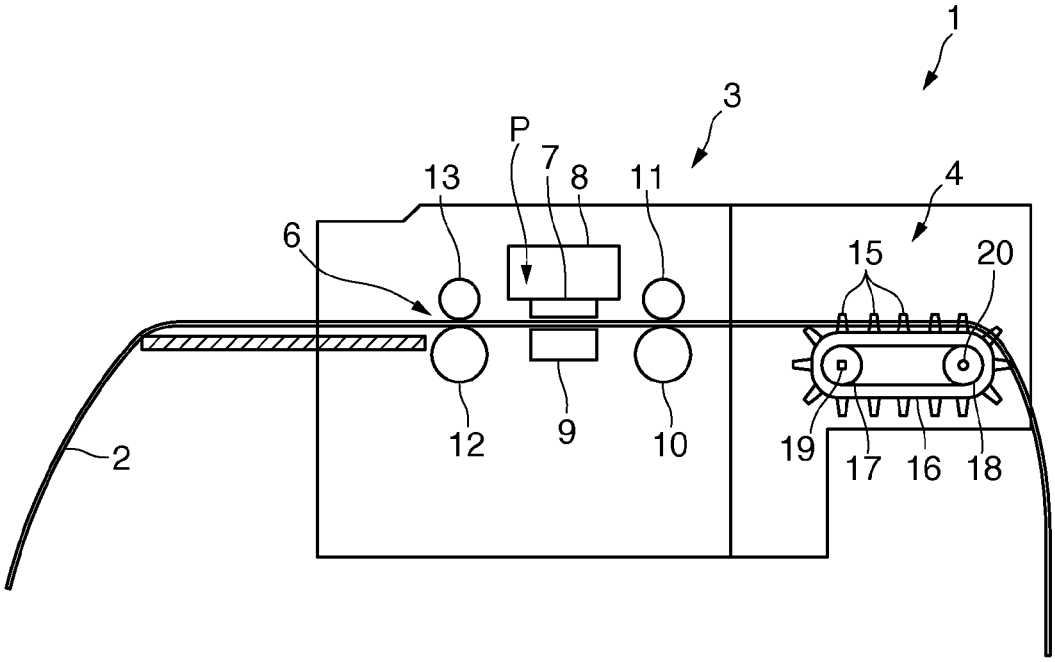
FIG. 2 is a schematic longitudinal section view showing main parts of the printer.
Figure 3:
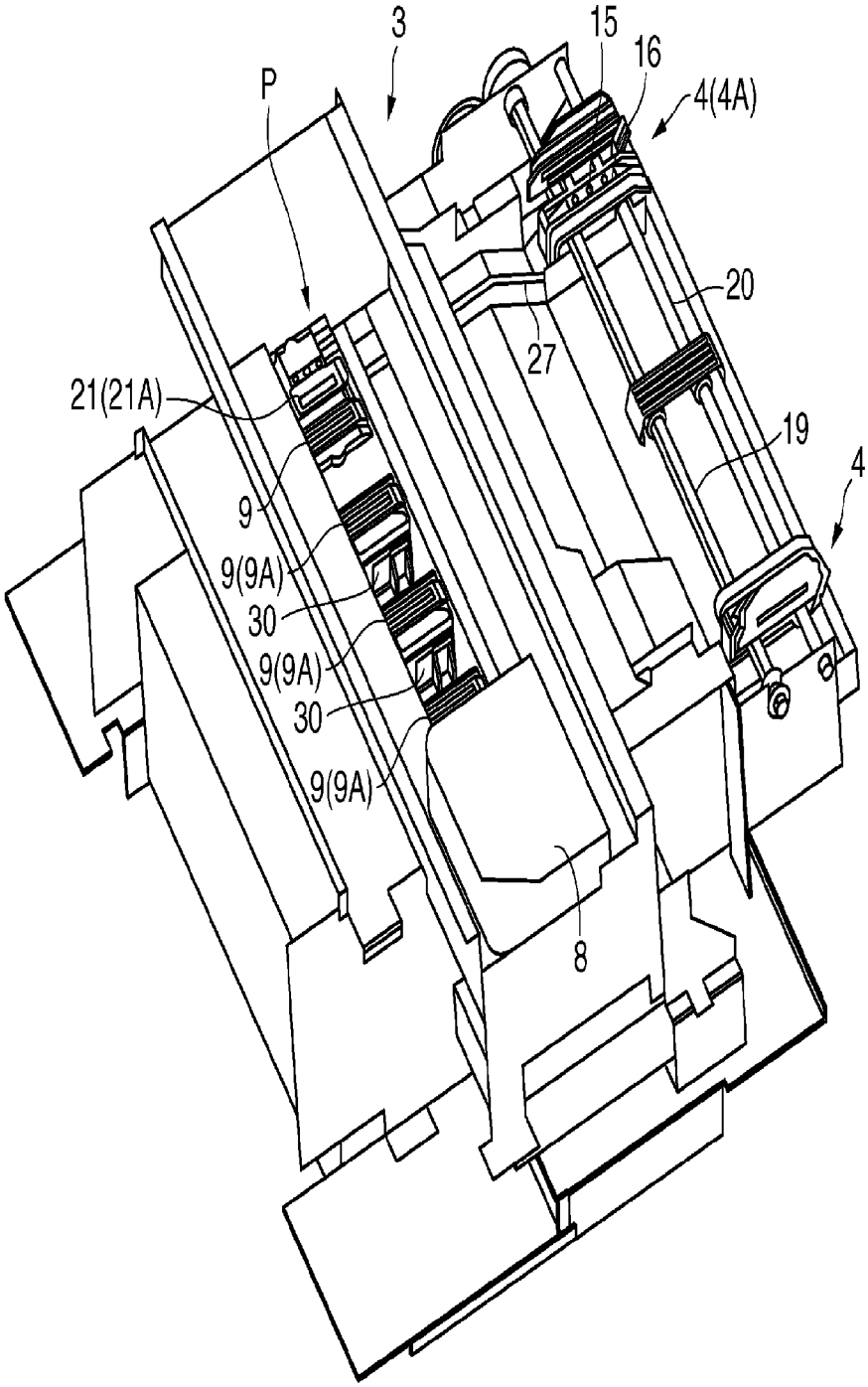
FIG. 3 is an oblique view of the printer shown in FIG. 1 with the case removed.
Figure 4:
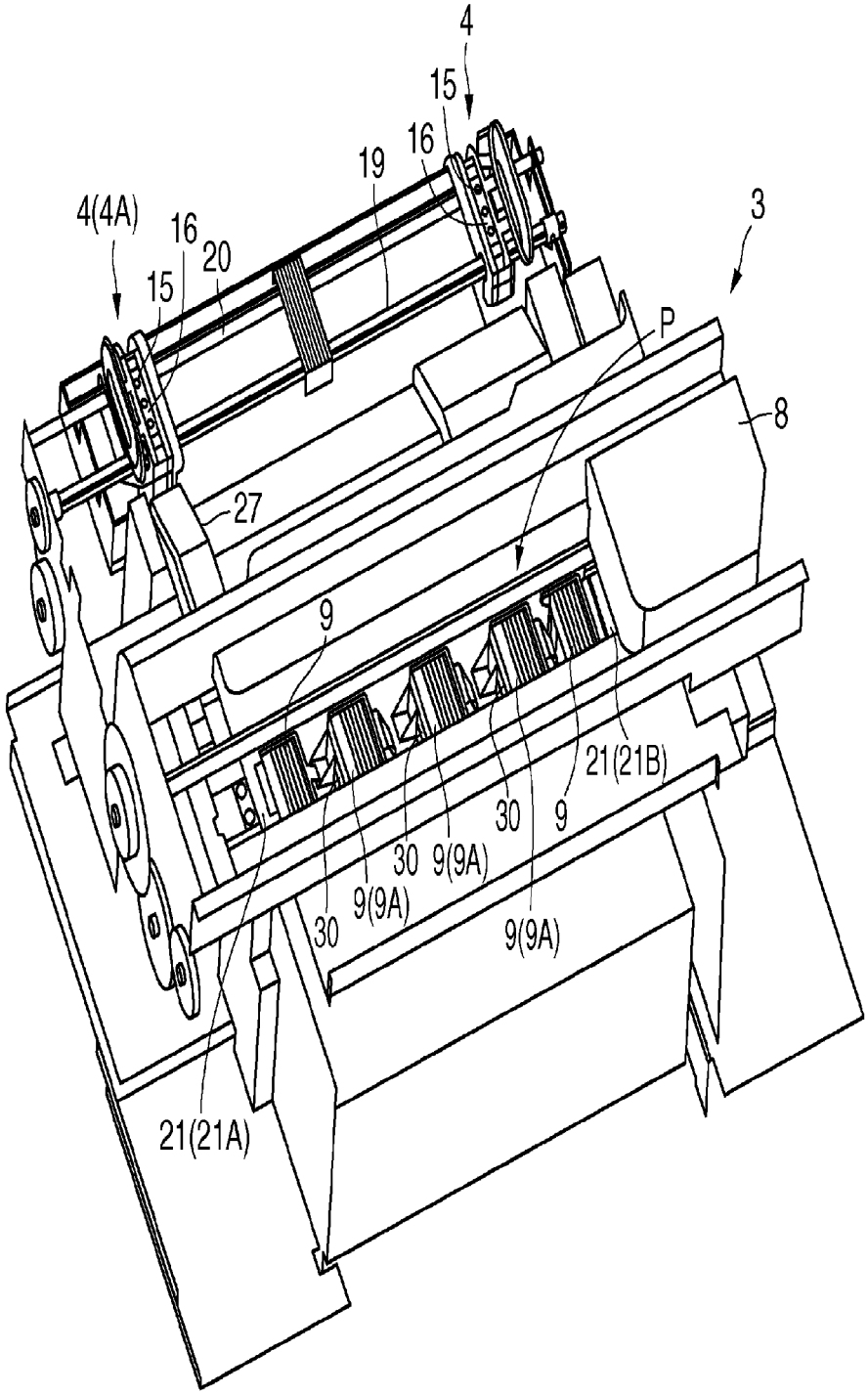
FIG. 4 is an oblique view of the printer from a different angle with the case removed.

FIG. 1 is an oblique view of a printer 1 according to a preferred embodiment of the invention. FIG. 2 is a schematic longitudinal view showing main parts of the printer 1. FIG. 3 is an oblique view of the printer 1 shown in FIG. 1 with the case 5 removed. FIG. 4 is an oblique view of the printer 5 from a different angle with the case 5 removed.

The printer 1 is a device that prints on continuous paper 2. Sprocket holes (feed holes) 2*a* are formed at a specific interval along the length of both widthwise edges of the continuous paper 2. The printer 1 has a printer unit 3, a tractor 4 disposed at the back end of the printer unit 3, and a printer case 5 that covers the printer unit 3 and tractor 4. The continuous paper 2 is conveyed from the back of the printer into the printer unit 3 by the tractor 4 and printed on, and is then discharged from the front of the printer unit 3. The direction between the back and front of the printer is thus the conveyance direction of the continuous paper 2. The direction between the left and right sides of the printer is also the paper width direction of the continuous paper 2.

A paper conveyance path 6 through which the continuous paper 2 is conveyed is formed inside the printer unit 3 straight between the back and front of the printer. A printhead 7 is disposed inside the printer unit 3. The printhead 7 can be an inkjet head that ejects ink droplets onto the continuous paper 2. If the print head 7 is an ink jet head, a plurality of nozzles that discharge ink droplets are formed in the printhead 7. The printhead 7 is disposed above the paper conveyance path 6. The printhead 7 is mounted on a carriage 8. The carriage 8 can travel sideways in the paper width direction by drive power from a drive mechanism including a drive motor, pulley, and belt.

A plurality of platen sections 9 that are separated in the paper width direction are disposed inside the printer unit 3. In this embodiment, for example, five platen sections 9 are disposed inside the printer unit 3. The platen sections 9 are disposed below the paper conveyance path 6. The platen sections 9 and printhead 7 are disposed at substantially the same position in the longitudinal direction of the printer. More specifically, as shown in FIG. 2, when seen from the side of the printer, the platen sections 9 and printhead 7 are disposed vertically opposite each other with a specific gap therebetween. In this embodiment of the invention, the plural platen sections 9 determine the printing area P where the printhead 7 prints on the continuous paper 2. The printing area P is also where the printhead 7 is located in the longitudinal direction of the printer.

A paper feed roller 10 for feeding the continuous paper 2 to the printing area P is disposed between the printing area P and the tractor 4. A pressure roller 11 for pressing the continuous paper 2 to the paper feed roller 10 contacts the paper feed roller 10 from above. The pressure roller 11 is pressed to the paper feed roller 10 with a specific urging force. A discharge roller 12 for discharging the printed continuous paper 2 is disposed toward the front of the printer from the printing area P. A pressure roller 13 for pressing the continuous paper 2 to the discharge roller 12 contacts the discharge roller 12 from above. The pressure roller 13 is pressed with a specific urging force to the discharge roller 12.

A tractor 4 is disposed on both left and right sides of the printer. Each tractor 4 has tractor pins 15 that are inserted to the sprocket holes 2*a* of the continuous paper 2. The tractor pins 15 are formed at a specific interval on the outside surface of the tractor belt 16. The tractor belt 16 is mounted on a drive pulley 17 and a follower pulley 18. In this embodiment of the invention a tractor 4 can move sideways in the printer so that different widths of continuous paper 2 can be conveyed and printed. However, only the tractor 4 on one side of the printer is moved when adjusting to the width of the continuous paper 2, and the tractor 4 on the other side of the printer does not move. The tractor 4 disposed on the one side of the printer is referred to below as tractor 4A.

A square through-hole is formed in the center of the drive pulley 17 passing through in the direction between the sides of the printer. A drive shaft 19 that is driven rotationally by drive power from a drive motor not shown passes through this through-hole. The drive shaft 19 is rotatably supported on the frame of the printer 1 with the axis of the shaft aligned in the paper width direction. The drive motor is connected to one end of the drive shaft 19 through a power transfer mechanism including pulleys and belts, for example. The drive shaft 19 is a square rod, and when the drive shaft 19 turns, the drive pulley 17 also turns in conjunction with the drive shaft 19.

A round guide hole is formed in the center of the follower pulley 18 passing through in the paper width direction. A round guide shaft 20 that guides the tractor 4A sideways to the printer is inserted to this guide hole. The guide shaft 20 is fixed to the printer 1 frame with its axis extending in the paper width direction. The follower pulley 18 can rotate on the guide shaft 20. The follower pulley 18 in the paper width direction along the guide shaft 20. Note that the drive pulley 17 of the tractor 4A can also move in the paper width direction along the drive shaft 19, and the drive shaft 19 also functions as a guide shaft that guides the tractor 4A in the paper width direction.

To convey the continuous paper 2 by the tractor 4, the continuous paper 2 is set so that the tractor pins 15 are inserted in the sprocket holes 2*a*. The drive shaft 19 and drive pulley 17 are then turned by drive power from the drive motor, causing the tractor pins 15 to sequentially engage the sprocket holes 2*a* and convey the continuous paper 2.

When printing to continuous paper 2, the printer 1 alternately performs a printing operation in which the printhead 7 moves in the scanning direction (that is, sideways to the printer) perpendicularly to the conveyance direction of the continuous paper 2 and prints, and a paper feed operation that advances the continuous paper 2 in specific increments.

Configuration of the Cover Member, Tractor, and Connecting Member

Figure 5A:
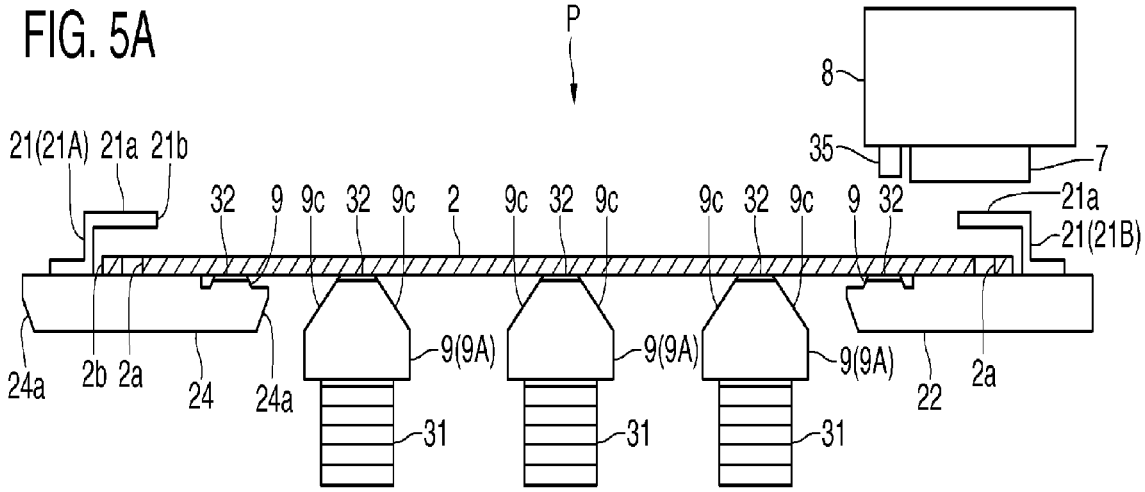
FIGS. 5A and 5B schematically show the configuration of the printer in the printing area.
Figure 5B:
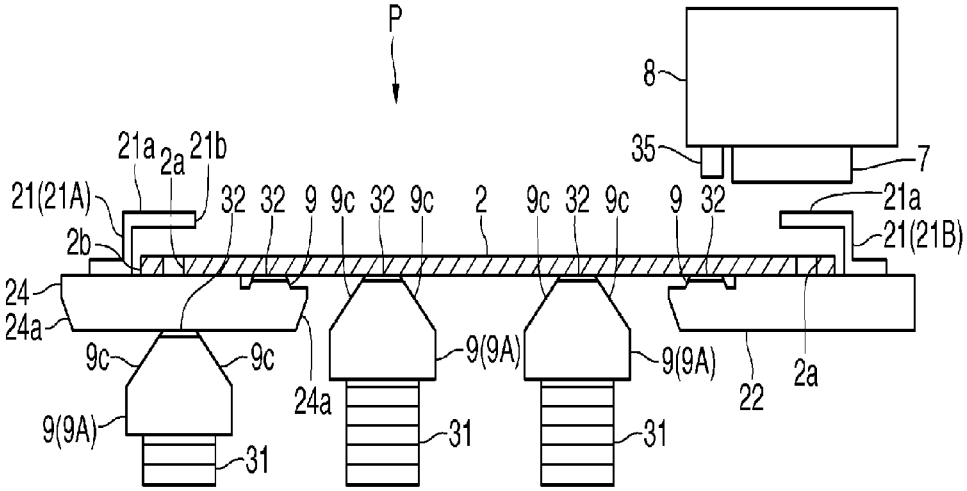
Figure 6:
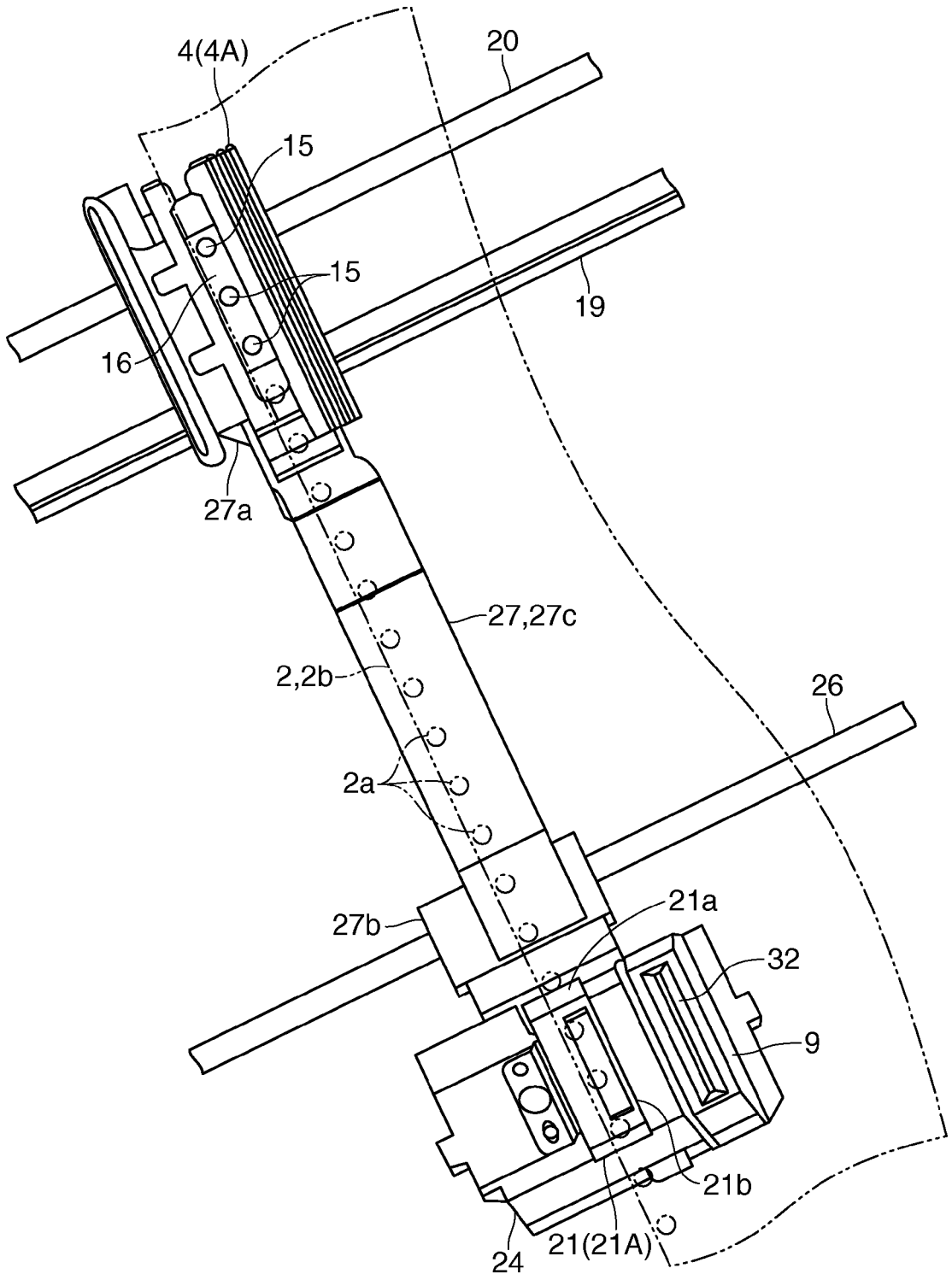
FIG. 6 is an oblique view of the movable cover, tractor, and connecting member from above.
Figure 7:
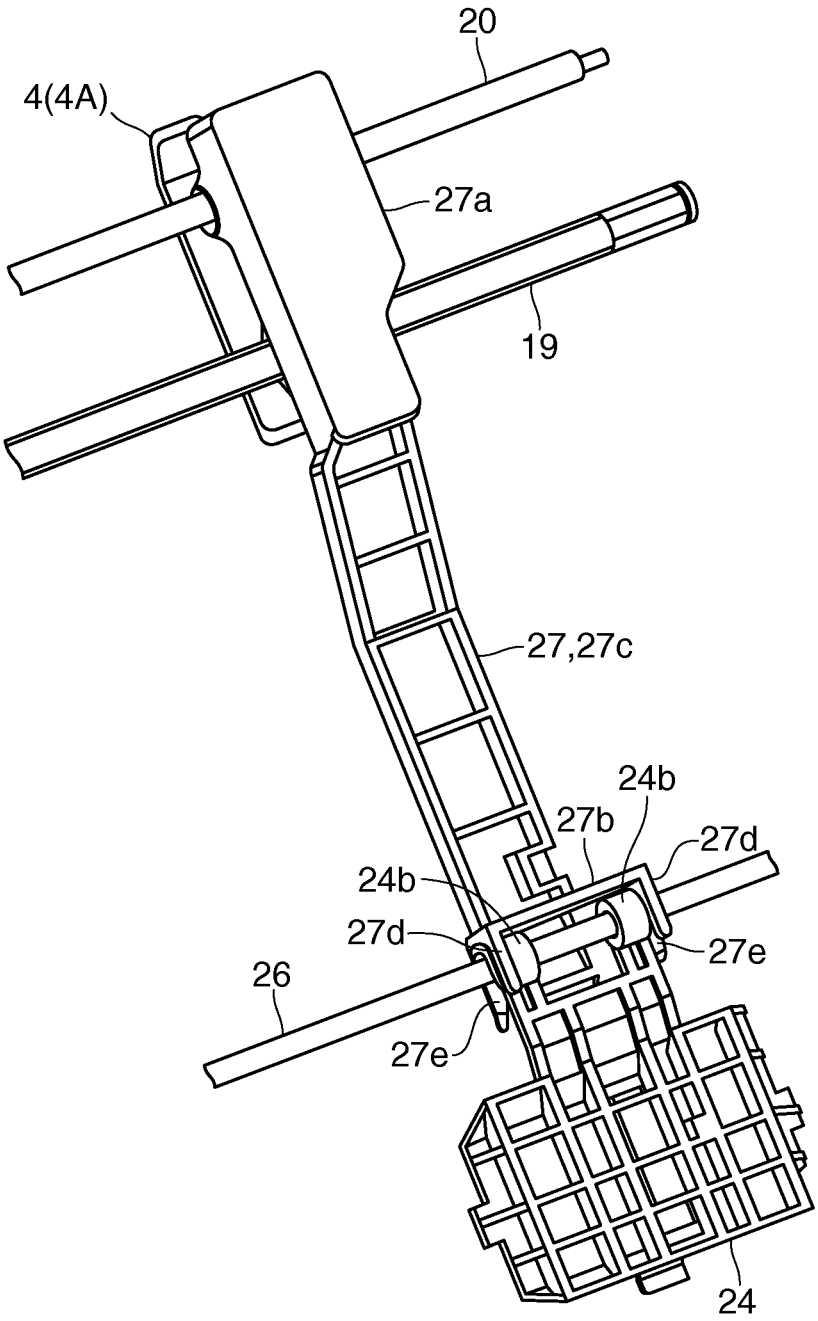
FIG. 7 is an oblique view of the movable support member, tractor, and connecting member from below.

FIGS. 5A and 5B show the configuration of the printer 1 in the printing area P. FIG. 6 is an oblique view of the movable cover member 21A, tractor 4A, and connecting member 27 from above. FIG. 7 is an oblique view of the movable support member 24, tractor 4A, and connecting member 27 from below.

As shown in FIGS. 5A and 5B, the printer 1 has a cover 21 that covers the sprocket holes 2*a* from above in the printing area P. A cover 21 is disposed on both the left and right sides of the printer. When seen from the side of the printer, the cover 21 is located below the printhead 7. In this embodiment of the invention, the cover 21 disposed on one side of the printer can move sideways on the printer in order to cover the sprocket holes 2*a* of different widths of continuous paper 2. The cover 21 disposed on the other side of the printer is stationary and does not move left and right.

The cover 21 is made from a member that reflects light. The cover 21 could be made by bending a thin steel plate into the desired shape, for example. The cover 21 has a cover part 21*a* that covers the sprocket holes 2*a* from above. The cover part 21*a* covers the entire sprocket hole 2*a* area from above in the paper width direction. The cover part 21*a* is formed extending from the outside to the inside from the left and right sides of the printer, and covers both edge parts of the continuous paper 2 including the edges of the continuous paper 2 at the sides of the paper. Note that cover part 21*a* in this embodiment of the invention is a cover reflector that is part of the cover 21 and reflects light.

The stationary-side cover 21 (cover member 21B below) on the other side of the printer width is fastened to the top of the support member 22 that supports the widthwise edge of the continuous paper 2 from below as shown in FIGS. 5A and 5B. The support member 22 is made from a black plastic or other member that is a poor light reflector (or does not reflect light). This support member 22 is fastened to the frame of the printer 1. The top surface of the inside part of the support member 22 in the transverse direction of the printer is one of five platen sections 9.

The movable cover 21 disposed on one side of the printer (cover member 21A below) is fastened to the top surface of a support member 24 that supports the widthwise edge part of the continuous paper 2 from below. The support member 24 is made from a black plastic or other member that is a poor light reflector (or does not reflect light). The top surface of the inside part of the support member 24 in the transverse direction of the printer is one of five platen sections 9. A tapered part 24*a* that slopes so that the width of the support member 24 becomes narrower in the paper width direction with proximity to the bottom is formed on both widthwise sides of the support member 24. As shown in FIG. 7, two protruding parts 24*b* that protrude toward the back are formed at the back of the support member 24. A round guide hole is formed in the protruding parts 24*b* passing therethrough in the paper width direction. A round guide shaft 26 that guides the cover member 21A and support member 24 widthwise to the printer passes through the guide hole. The guide shaft 26 is affixed to the printer 1 frame with its axis widthwise to the printer.

The tractor 4A and cover member 21A are connected by a connecting member 27. More specifically, the tractor 4A and support member 24 are connected by the connecting member 27. As a result, the tractor 4A and cover member 21A move together sideways to the printer. The connecting member 27 has a tractor mount 27*a* on which tractor 4A is mounted, and an engaging part 27*b* that engages the support member 24. The tractor mount 27*a* and engaging part 27*b* are connected by the connecting part 27*c*.

The engaging part 27*b* includes a pair of stops 27*d* formed so that the two protruding parts 24*b* of the support member 24 are therebetween sideways to the printer. A slot 27*e* that is U-shaped when seen from the side of the printer is formed in the stops 27*d*. The guide shaft is inserted to this slot 27*e*. The slot 27*e* is formed so that the cover member 21*a* side of the stops 27*d* is open.

When the width of the continuous paper 2 used in the printer 1 is changed, the user holds a particular part of the tractor 4A and moves the tractor 4A sideways to the printer. When the tractor 4A moves sideways to the printer, the inside face of the stops 27*d* of the connecting member 27 sideways to the printer contact the outside face of the protruding parts 24*b* sideways to the printer, and the cover member 21A moves with the support member 24 sideways to the printer.

Configuration of the Platen Sections and Adjacent Area

Figure 8:
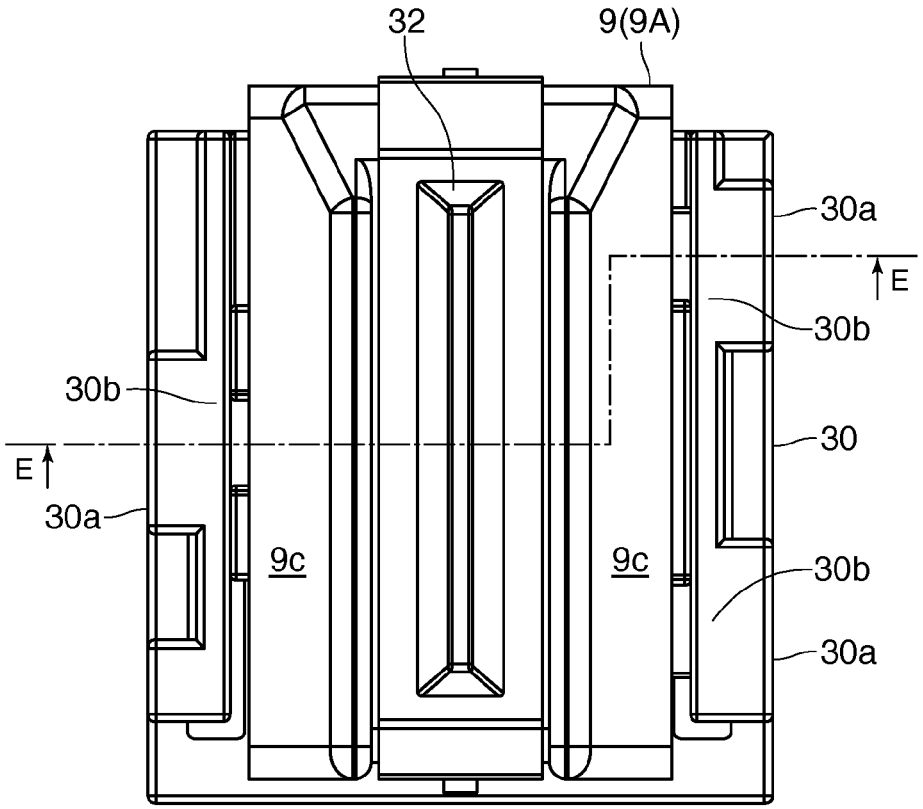
FIG. 8 is a plan view of a platen section and support member.
Figure 9:
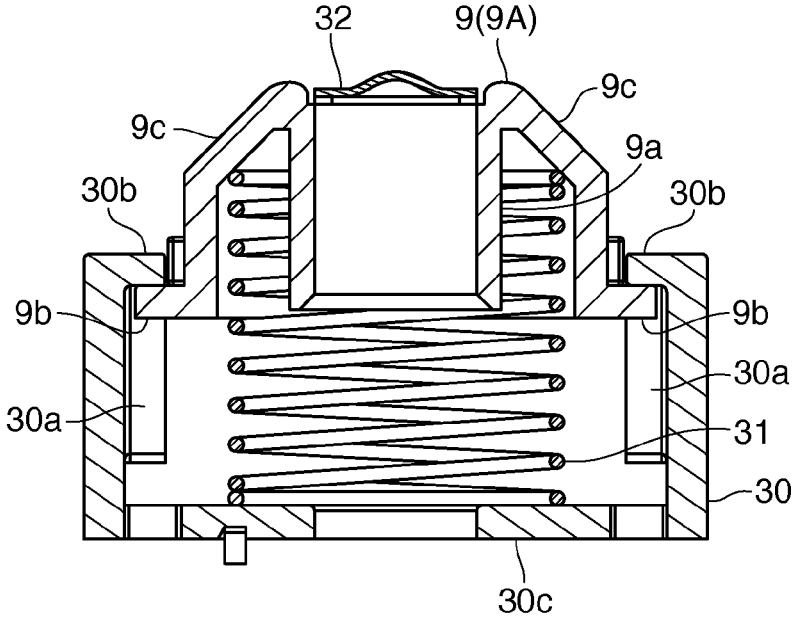
FIG. 9 is a section view through E-E in FIG. 8.

FIG. 8 is a plan view of a platen section 9 and the support member 30. FIG. 9 is a section view through E-E in FIG. 8.

Part of the support member 22 is thus one platen section 9 of the five platen sections 9, and part of support member 24 is one platen section 9 of the five platen sections 9. The remaining three platen sections 9 are supported by support members 30 disposed at a specific interval widthwise to the printer. The platen sections 9 supported by the support members 30 can move vertically relative to the support member 30. Each platen section 9 supported by a support member 30 is urged upward by a compression spring 31. A platen section 9 supported vertically movable by a particular support member 30 is referred to as a movable platen 9A below.

The movable platen 9A is made from a black plastic or other member that is a poor light reflector (or does not reflect light). As shown in FIG. 9, the movable platen 9A is hollow. A tubular spring insertion portion 9*a* that is inserted into the top end of the compression spring 31 is formed on the inside of the movable platen 9A. A flange 9*b* protruding to the outside widthwise to the printer is formed at the bottom end of the movable platen 9A. A sloped face 9*c* is formed at the top end of the movable platen 9A so that the width of the movable platen 9A widthwise to the printer narrows towards the top.

As shown in FIG. 9, the support member 30 is shaped like a box with an open top. The support member 30 is fastened to the printer 1 frame. A guide member 30*a* that guides the flange 9*b* vertically is formed on the outside of the support member 30 widthwise to the printer. The guide member 30*a* is shaped like a channel engaged by the flange 9*b*, and restricts movement of the flange 9*b* longitudinally and sideways to the printer. A stop 30*b* that limits the range of upward movement of the movable platen 9A is formed contacting the top of the flange 9*b* at the top end of the guide member 30*a*.

The bottom end of the compression spring 31 contacts the top of the bottom 30*c* of the support member 30. The top end of the compression spring 31 contacts the inside part of the top end of the movable platen 9A. The spring insertion portion 9*a* of the movable platen 9A is inserted to the top end of the compression spring 31.

Thus configured, the cover member 21A moves widthwise relative to the printer when the width of the continuous paper 2 used in the printer 1 changes. For example, when the cover member 21A moves to the other side widthwise to the printer (toward cover member 21B), the tapered part 24*a* of the support member 24 and the sloped face 9*c* of the movable platen 9A touch, and the movable platen 9A gradually retreats down against the urging force of the compression spring 31 as shown in FIG. 5B. When the cover member 21A then moves to the outside from this position widthwise relative to the printer, the retracted movable platen 9A rises to where the flange 9*b* and the stop 30*b* contact due to the urging force of the compression spring 31 as shown in FIG. 5A. The movable platen 9A can thus move vertically so that the cover member 21A can move sideways to the printer.

As shown in FIGS. 8 and 9, a support plate 32 made from a light-reflecting member is attached to the top end of the platen section 9. This support plate 32 could be a thin steel plate, for example. The bottom of the continuous paper 2 passing the printing area P contacts the support plate 32. The support plate 32 in this embodiment is a platen reflection unit that is formed on the platen section 9 and reflects light.

Structure and Method of Detecting the Position of the Edge of Continuous Paper

Figure 10:
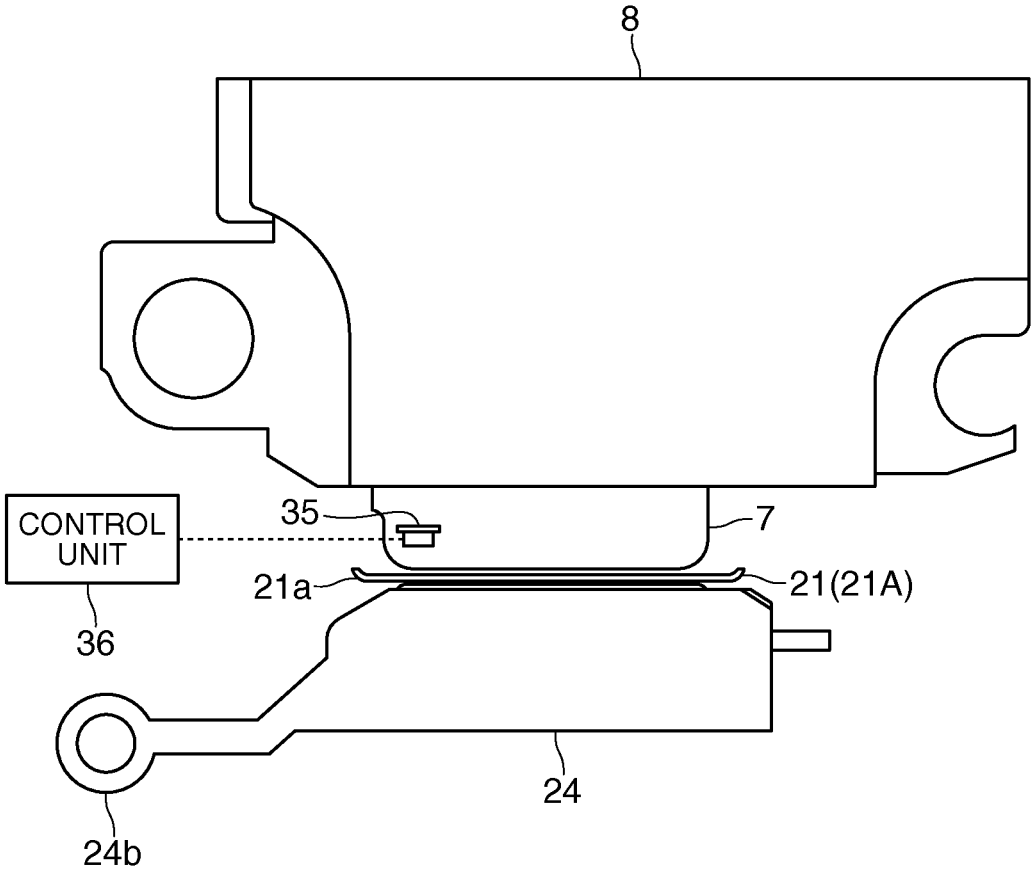
FIG. 10 shows the printhead, carriage, and movable cover from the side of the paper width.
Figure 11:
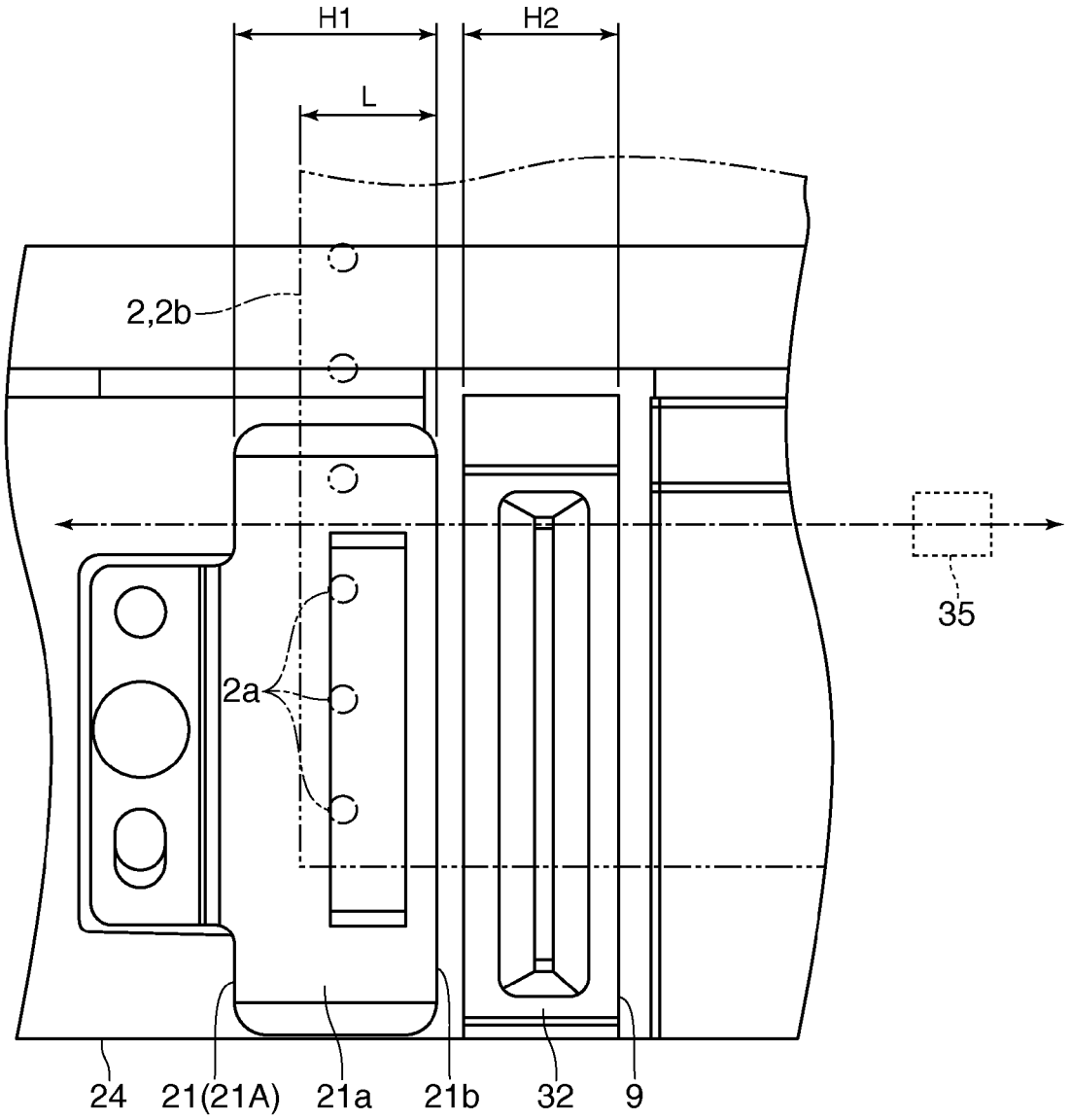
FIG. 11 is an enlarged plan view of the movable cover and surrounding parts.

FIG. 10 shows the printhead 7, carriage 8, and movable cover member 21A from the side of the printer. FIG. 11 is an enlarged plan view of the movable cover member 21A and adjacent area.

As described above, only the tractor 4A on the one side of the printer moves, and the tractor 4 on the other side of the printer does not move, when the continuous paper 2 width is changed. As a result, the position of the paper edge on the other side of the printer is always the same, even when the continuous paper 2 width changes. However, when the continuous paper 2 width is changed, the position of the paper edge 2*b* on the one side of the printer changes. Therefore, in order to prevent the printhead 7 from ejecting ink droplets anywhere other than on the continuous paper 2 in the paper width direction after the continuous paper 2 width is changed, the position of the paper edge 2*b* of the continuous paper 2 must be determined. However, because the paper edge 2*b* is covered by the cover part 21*a* of the cover member 21A, the paper edge 2*b* cannot be directly detected in the printing area P.

This embodiment of the invention therefore detects the position of the cover member 21A in the transverse direction, and determines the position of the paper edge 2*b* from this detected cover member 21A. The printer 1 has a detection mechanism 35 for detecting the position of the cover member 21A in the transverse direction, and a control unit (edge position determination means) 36 connected to the detection mechanism 35.

The detection mechanism 35 is an reflective optical sensor having a light-emitting device and an adjacently disposed photodetector device. The detection mechanism 35 is disposed to the bottom of the carriage 8, and moves sideways. As shown in FIG. 11, the detection mechanism 35 is disposed to the carriage 8 so that the detection mechanism 35 passes over the support plate 32 attached to the top of the platen section 9 and the rear end part of the cover part 21*a* of the cover member 21A. The light-emitting device of the detection mechanism 35 emits light downward, and the photodetector senses light reflected by the cover part 21*a*, for example.

Because the cover member 21A moves sideways in conjunction with the tractor 4A as described above, the distance between the tractor pins 15 of the tractor 4A and the inside side edge 21*b* of the cover part 21*a* is substantially constant. The distance in the transverse direction between the sprocket holes 2*a* engaged by the tractor pins 15 of the tractor 4A and the edge 21*b* of the cover part 21*a* is therefore substantially constant, and the distance L (see FIG. 11) between the edge 2*b* of the continuous paper 2 and the edge 21*b* of the cover part 21*a* is also substantially constant.

Based on output from the detection mechanism 35, the control unit 36 in this embodiment of the invention detects the edge 21*b*, and determines the position of the edge 2*b* of the continuous paper 2 based on the detected position of edge 21*b*. For example, because the output level of the photodetector of the detection mechanism 35 changes when the detection mechanism 35 passes over the edge 21*b*, the control unit 36 detects the position of the edge 21*b* from the position where the output level of the photodetector of the detection mechanism 35 changed, and determines the position of the paper edge 2*b* by adding distance L to the detected position of the edge 21*b*, for example. This embodiment of the invention determines the position of the paper edge 2*b* before printing to the continuous paper 2 after the continuous paper 2 is set in the tractor 4 and the continuous paper 2 is supplied to the printing area P. The rear end part of the platen section 9 is therefore covered by the continuous paper 2 when the position of the paper edge 2*b* is determined.

Main Effect of this Embodiment of the Invention

As described above, the printer 1 according to this embodiment of the invention has cover members 21A, 21B that cover the sprocket holes 2*a* from above in the printing area P. As a result, paper dust produced from the sprocket holes 2*a* can be prevented by the cover members 21A, 21B from rising to the printhead 7. Paper dust produced from the sprocket holes 2*a* can thus be prevented from sticking to the nozzles of the printhead 7, and printhead 7 nozzle clogging caused by paper dust can therefore be prevented.

Cover member 21A in this embodiment of the invention can move widthwise relative to the printer, and the movable platen 9A can move vertically so that movement of the cover member 21A sideways to the printer is possible. As a result, the cover member 21A can be moved in the paper width direction according to the width of the continuous paper 2 when the width of the continuous paper 2 used in the printer 1 changes even if the movable platen 9A is in the printing area P. More specifically, the sprocket holes 2*a* can be covered by the cover member 21A even when the width of the continuous paper 2 changes. Paper dust produced from the sprocket holes 2*a* can therefore be prevented from sticking to the nozzles of the printhead 7 even when the width of the continuous paper 2 changes, and clogging of the printhead 7 nozzles due to paper dust can be prevented.

This embodiment of the invention detects the position of the edge 21*b* of the cover part 21*a* in the printing area P, and determines the position of the paper edge 2*b* of the continuous paper 2 from the detected edge 21*b*. The position of the paper edge 2*b* can therefore be detected even when the paper edge 2*b* is covered by the cover part 21*a*, and the width of the continuous paper 2 that is set in the printer 1 can be determined. This embodiment can therefore use the printhead 7 to print to the continuous paper 2 within the range of the determined paper width, and as a result can prevent the printhead 7 from ejecting ink droplets outside of the continuous paper 2. More specifically, because the position of the paper edge 2*b* is determined in the printing area P, the position of the paper edge 2*b* determined based on the detection result from the detection mechanism 35 matches the position of the paper edge 2*b* in the part of the continuous paper 2 where the printhead 7 actually ejects ink droplets. This embodiment can therefore reliably prevent the printhead 7 from ejecting ink droplets outside of the continuous paper 2.

In this embodiment the cover member 21A and tractor 4A are connected by the connecting member 27, and the cover member 21A moves sideways to the printer in conjunction with the tractor 4A. More specifically, the cover member 21A moves sideways in conjunction with the tractor 4A moving according to the width of the continuous paper 2 that is used in the printer 1. The sprocket holes 2*a* can therefore be covered by the cover member 21A by moving the tractor 4A. Moving the cover member 21A when the continuous paper 2 width changes is therefore simple. The cover member 21A can therefore be moved reliably when the width of the continuous paper 2 changes.

Furthermore, because the cover member 21A moves sideways in conjunction with the tractor 4A in this embodiment, the distance L between the paper edge 2*b* of the continuous paper 2 and the edge 21*b* of the cover part 21*a* is always substantially constant. The position of the paper edge 2*b* can therefore be determined with good precision based on the result of detecting the position of edge 21*b*, and the width of the continuous paper 2 can be determined with good precision as a result.

The detection mechanism 35 in this embodiment is a reflective photodetector having a light-emitting device and an adjacently disposed photodetector. As a result, the position of the cover member 21A can be detected using the detection mechanism 35 by attaching the detection mechanism 35 to the carriage 8. The detection mechanism 35 can therefore be positioned more easily than when the detection mechanism is a transmissive photodetector having the light-emitting device and photodetector disposed with the cover member 21A therebetween. In addition, because the detection mechanism 35 is attached to the carriage 8 in this embodiment, the position of the cover member 21A, which can move in the transverse direction, can be detected using a single detection mechanism 35.

Other Embodiments

The position of the paper edge 2*b* is determined in this embodiment before printing to the continuous paper 2 after continuous paper 2 is set in the tractor 4 and the continuous paper 2 is supplied to the printing area P, but the position of the paper edge 2*b* could be determined after the continuous paper 2 is set in the tractor 4 and before the continuous paper 2 is supplied to the printing area P. In this case the detection mechanism 35 passes over the back ends of the platen sections 9 that are not covered by the continuous paper 2. More specifically, in addition to the top of the cover part 21*a*, the detection mechanism 35 passes over the top of the support plate 32 that is made of a light-reflecting member. As a result, the position of the edge 21*b* of the cover part 21*a* cannot be detected only from the change in the output level of the photodetector of the detection mechanism 35 because the control unit 36 cannot differentiate between detection of the cover part 21*a* and detection of the support plate 32.

This can be solved by forming the cover part 21*a* and the support plate 32 so that the width H1 (FIG. 11) of the cover part 21*a* and the width H2 (FIG. 11) of the support plate 32 differ in the transverse direction. For example, the cover part 21*a* and the support plate 32 could be formed so that the width H1 of the cover part 21*a* is greater than the width H2 of the support plate 32. If the carriage 8 then travels at a constant speed, and the carriage 8 moves so that the detection mechanism 35 crosses the cover part 21*a* and support plate 32, the detection time of the detection mechanism 35 when the cover part 21*a* is detected (that is, the time that the photodetector of the detection mechanism 35 detects light reflected from the cover part 21*a*), and the detection time of the detection mechanism 35 when the support plate 32 is detected (that is, the time that the photodetector of the detection mechanism 35 detects light reflected from the support plate 32), will differ. Whether the cover part 21*a* was detected or the support plate 32 was detected can therefore be differentiated based on the detection time of the detection mechanism 35, and the position of the edge 21*b* of the cover part 21*a* can be detected from the position where the output level of the photodetector of the detection mechanism 35 changes when the cover part 21*a* is detected. More specifically, the cover member 21A and the platen sections 9 can be differentiated based on the detection time of the detection mechanism 35 even when a platen section 9 with a light-reflecting support plate 32 is located in the printing area P, and the position of the edge 21*b* of the cover part 21*a* can be appropriately detected. In addition, the position of the paper edge 2*b* of the continuous paper 2 can be determined from the position of the detected edge 21*b*.

The cover member 21A and the tractor 4A are connected by the connecting member 27 in the foregoing embodiment, but the cover member 21A and the tractor 4A do not have to be connected. In this case, if a contact that touches the paper edge 2*b* of the continuous paper 2 is disposed on the cover member 21A and the width of the continuous paper 2 changes, for example, the cover member 21A can be positioned so that the paper edge 2*b* contacts this contact. Alternatively, if an index mark that is aligned with the paper edge 2*b* is formed on a longitudinal end of the cover member 21A, the cover member 21A can be positioned transversely so that this index is aligned with the paper edge 2*b*. The position of the paper edge 2*b* can also be determined in this case based on the result of detecting the position of the edge 21*b* of the cover part 21*a*.

The detection mechanism 35 detects the edge 21*b* on the inside side of the cover part 21*a* in the transverse direction in the foregoing embodiment, but the detection mechanism 35 could detect the edge 21*b* on the outside side of the cover part 21*a* in the transverse direction. The detection mechanism 35 could also detect any desired position of the cover member 21A. In this case, the cover member 21A is made from a member that reflects light poorly (or does not reflect light), and a mark made from a light-reflecting member for position detection is formed on the cover member 21A.

The detection mechanism 35 in the foregoing embodiment is a reflective optical sensor, but the detection mechanism 35 could be a transmissive optical sensor. The detection mechanism 35 could also be a mechanical sensor that detects the position of the cover member 21A by contacting the cover member 21A. The detection mechanism 35 could also be rendered with a lever that contacts the cover member 21A and moves, and an optical sensor that detects this lever.

A single detection mechanism 35 is disposed on the carriage 8 in the embodiment described above, but two or more detection mechanisms 35 could be disposed to the carriage 8. Further alternatively, the detection mechanism 35 could be attached to the printer 1 frame instead of the carriage 8. In this case, a plurality of detection mechanisms 35 are attached to the printer 1 frame.

The cover member 21B is fastened to the printer 1 frame in the embodiment described above, but the cover member 21B could be able to move in the transverse direction. In this case, the position of the cover member 21B in the transverse direction could be detected, and the position of the other edge of the continuous paper 2 in the transverse direction can be detected in the same way as the position of the paper edge 2*b* of the continuous paper 2 is detected above.

What is claimed is:

1. A method of controlling a printer that has a printhead configured to eject ink droplets toward continuous paper, a cover member configured to cover from above a part of a width of the continuous paper and configured to move in a paper width direction, a detector configured to detect the cover member, and a controller configured to determine a position of an edge of the continuous paper in the paper width direction based on the cover member the control method comprising steps of:

detecting a position of the cover member in the paper width direction; and determining the position of an edge of the continuous paper in the paper width direction based on the detected position of the cover member in the paper width direction.

2. The method of controlling a printer described claim 1, wherein the printer further comprises a tractor that is configured to move in the paper width direction and that conveys the continuous paper while engaging tractor pins sequentially in feed holes of the continuous paper, and wherein the cover member configured to cover from above the continuous paper at least in the printhead installation area, the control method further comprising:

moving the cover member and the tractor together in the paper width direction.

3. The method of controlling a printer described claim 1, further comprising:

moving a carriage so that the detector crosses the cover member.

4. The method of controlling a printer described claim 1, the printer further comprising a cover reflector configured to reflect light and disposed on the cover member and a platen reflector configured to reflect light and disposed on a platen section, wherein the detector is a reflective photodetector including a light emitting device and a photodetection device that detects light emitted from the light-emitting device and reflected by the cover reflector, the control method further comprising:

differentiating whether the cover reflector or the platen reflector detected; and determining the position of the cover member in the paper width direction, based on a time that the photodetection device detects light reflected by the cover reflector and a time that the photodetection device detects light reflected by the platen reflector.

5. A printer comprising:

a printhead configured to eject ink droplets toward continuous paper having feed holes formed therein in a conveyance direction along both edge parts of a width of the continuous paper;

a carriage on which the printhead is mounted, the carriage being configured to move in the paper width direction;

a cover member configured to cover at least one of the edge parts of the continuous paper and move in a paper width direction;

a detector disposed on the carriage and configured to detect a position of the cover member in the paper width direction;

a controller configured to determine a position of an edge of the continuous paper in the paper width direction based on the detected position of the cover member in the paper width direction;

a plurality of platen sections disposed in a printhead installation area in the conveyance direction and separated in the paper width direction;

a cover reflector that reflects light and is disposed on the cover member; and a platen reflector that reflects light and is disposed on at least one of the plurality of platen sections, wherein a width of the cover reflector in the paper width direction and a width of the platen reflector in the paper width direction are different, and the detector is a reflective photodetector including a light-emitting device and a photodetection device that detects light emitted from the light-emitting device and reflected by the cover reflector or the platen reflector.

6. The printer described in claim 5, further comprising:

a tractor configured to move in the paper width direction and convey the continuous paper while engaging tractor pins sequentially in the feed holes; and a connecting member configured to connect the tractor and the cover member, wherein the cover member and the tractor move together in the paper width direction.

* * * * *